US006903508B1

(12) United States Patent
Arnold

(10) Patent No.: US 6,903,508 B1
(45) Date of Patent: Jun. 7, 2005

(54) LIGHT SOURCE AND METHOD FOR PRODUCING A LIGHT SOURCE

(75) Inventor: Jörg Arnold, Heidelberg (DE)

(73) Assignee: IP2H AG, Bern (CH)

( * ) Notice: Subject to any disclaimer, the term of this patent is extended or adjusted under 35 U.S.C. 154(b) by 0 days.

(21) Appl. No.: 10/069,260

(22) PCT Filed: Mar. 24, 2000

(86) PCT No.: PCT/DE00/00912

§ 371 (c)(1),
(2), (4) Date: Feb. 22, 2002

(87) PCT Pub. No.: WO01/15207

PCT Pub. Date: Mar. 1, 2001

(30) Foreign Application Priority Data

Aug. 22, 1999 (DE) ..... 199 39 903
Oct. 8, 1999 (DE) ..... 199 48 420

(51) Int. Cl.[7] ..... H01J 17/04
(52) U.S. Cl. ..... 313/631; 313/326; 313/491
(58) Field of Search ..... 313/112, 631, 313/632, 315, 326, 333, 341, 271, 272, 273, 113, 578, 278

(56) References Cited

U.S. PATENT DOCUMENTS 1,726,365 A * 8/1929 Pirani ..... 313/316
1,863,152 A 6/1932 Barkey
3,237,284 A * 3/1966 Bird ..... 445/48
3,788,721 A 1/1974 Vause
3,927,989 A * 12/1975 Koo ..... 419/4
4,123,833 A 11/1978 Choyke et al.
4,144,473 A * 3/1979 Almer ..... 313/315
4,585,971 A 4/1986 Clegg
5,330,854 A * 7/1994 Singh ..... 428/698
5,666,017 A * 9/1997 McGuire ..... 313/110
6,555,948 B1 4/2003 Noll

FOREIGN PATENT DOCUMENTS

DE 44 38 870 A1 5/1996
DE 19843852 * 3/2000 ..... 313/316
EP 0 272 687 A2 6/1988
FR 2 357 062 A 1/1978
JP 56011832 A 2/1981
JP 06013053 A 1/1994
SU 922 915 B 4/1982
WO WO 90/16137 A1 12/1990

* cited by examiner

*Primary Examiner*—Joseph Williams
(74) *Attorney, Agent, or Firm*—Alston & Bird LLP

(57) ABSTRACT

A light source, in particular incandescent lamp, with a bulb (1), a filament (2) arranged in the bulb (1), and a heating device (3) for the filament (2), the filament (2) emitting both visible light and heat radiation, is designed and constructed with respect to a high conversion efficiency between an electrical power input and emitted light output such that the filament (2) includes a flat section (4). A light source of this type may be produced by a method, wherein initially a filament (2) of a sintered metal powder is provided. Subsequently, the filament (2) is exposed to an atmosphere of carbon dioxide or of carbon dioxide and inert gas for forming a metal carbide. Finally, the filament (2) is sealed into the bulb (1).

15 Claims, 4 Drawing Sheets

LIGHT SOURCE AND METHOD FOR PRODUCING A LIGHT SOURCE

"This application is a 371 of PCT/DE00/00912, filed on Mar. 24, 2000."

BACKGROUND OF THE INVENTION

The invention relates to a light source, in particular incandescent lamp, with a bulb, a filament arranged in the bulb, and a hearing device for the filament, the filament emitting both visible light and heat radiation. Furthermore, the invention relates to a method for producing a light source of the above mentioned type.

Light sources of the described type have been known from practice for a long time, and they exist in a large variety of designs and sizes. In this connection, for example, incandescent lamps are known as electrical light sources, in which it is common to bring a tungsten filament by electrical Joule heat to a highest possible temperature. In this process, a temperature radiation is generated. The light yield of incandescent filaments considerably increases as the temperature rises. Besides that, also so-called nonthermal sources of radiation are known, for example, discharge lamps, such as inert gas-, mercury-, sodium-, and metal halide discharge lamps in high-pressure and low-pressure designs.

All so far known, electrically operated types of light sources have the disadvantage that they are very inefficient with respect to converting electric power to visible light output. The conversion barely exceeds 30%. The largest portion of the consumed electric power is an uneconomical dissipation primarily in the form of heat.

A possibility of increasing the efficiency of known light sources consists in that the heat radiated from the filament or glow wire, is reflected from the inner side of the bulb back to the filament or glow wire. As a result, the filament or glow wire undergoes a kind of backheating. This results in that after reaching the same filament temperature, less electric power will be needed than during a heating without reflection. The visible light output, which is transmitted through the bulb, remains in this instance the same. In the ideal case, only that electric power will be needed, which corresponds to the visible, emitted light output and to the thermal dissipation, which is absorbed by the bulb. Thus, the conversion efficiency is improved by the portion of the reflected heat radiation. Theoretically, it would be possible to increase with that the conversion efficiency to as much as 75% or 140 lumens/watt, if one took as a basis the standard thermal dissipation of tungsten lamps of about 25%, and if one neglected the radiation absorption of a mirror coating on the inner side of the bulb. In this connection, for example, dielectric mirror coatings have an absorption of typically 0.1%.

In the case of a mirror coating on the inner side of the bulb with a reflection power of, for example, 99.9%, statistically, every one thousandth photon in the material of the mirror coating will be absorbed. In the case of a reflection of the radiation into the bulb, the photon flux may therefore undergo only 1000 reflections on the inner side of the bulb, until it its totally absorbed in the bulb.

The known filaments present a problem in that, for example, the known spiral form of the filaments or glow wires permits only a very slight absorption of the reflected heat radiation, since the largest portion of the heat radiation is reflected past the thin spiral wire. Thus, an effective absorption or backheating is not possible in the case of conventional filaments or glow wires. Consequently, a high conversion efficiency is not realizable with conventional light sources.

It is therefore an object of the present invention to describe a light source of the initially described type as well as a method for producing such a light source, wherein a high conversion efficiency is achieved with simple means.

SUMMARY OF THE INVENTION

The foregoing object is accomplished by the provision of a light source having a filament which includes a flat section.

In accordance with the invention, it has been recognized that the likelihood of the photon flux striking on its path of reflection the filament or glow wire and being there absorbed, is proportional to the ratio of the filament volume or filament surface to the reflecting bulb volume or reflecting bulb surface. To realize a highest possible backheating of the filament, it will be advantageous, when a large filament surface is present, so that the photon flux strikes the filament after fewest possible reflections on the inner side of the bulb, and that it is there absorbed.

Consequently, the light source of the present invention defines a light source, which permits realizing a high conversion efficiency with simple means.

To optimize the reflection behavior of the inner side of the bulb, which is transparent for visible light, the bulb could include a mirror coating on its inner side. In a particularly favorable manner, the mirror coating could be a dielectric multilayer coating. With that, a spectrally selective mirror coating is present, which largely reflects the portion of heat radiation and transmits the portion of visible radiation.

An enlarged filament surface could result in the disadvantage that the electrical resistance of the filament becomes smaller, since the conductor surface that is decisive for the electric current becomes larger. From this follows, that for reaching the filament temperature necessary for the light emission, a considerably higher current is required in the filament than in the case of a normal filament surface or normal filament cross section. This may lead to safety problems for the user of the light source. In summary, this case presents a dilemma with respect to a largest possible filament surface and the therefor required and disadvantageous high currents. Furthermore, a large-surface filament could involve the disadvantage that it is mechanically unstable in particular in the case of substantial heating, and that it is deformed as a result of the effect of gravity. In the extreme case, the filament could come into contact with the inner side of the bulb, and/or become inoperative.

To solve the foregoing problematic situation, the filament could be made at least in part from a sintered metal. One could visualize such a sintered metal as a porous sponge, in which the powder elements or grains of the basic material include in most cases only point welding contacts relative to one another. This results in an extremely small, effective, and electrically conductive cross section and an increased effective conductor length. Furthermore, the sintered material exhibits a high mechanical stability. Therefore, an increased electrical resistance on the one hand and an increased mechanical strength on the other hand are made available by the use of the sintered metal powder. This favors the use of large-surface filaments.

The filament or the metal powder could include tungsten, and/or tantalum, and/or rhenium, and/or niobium, and/or zirconium. In practice, tantalum has shown to be especially favorable. In the alternative or in addition thereto, the filament could be composed at least in part of a nonmetal. Likewise, this makes it possible to achieve an increase in the electrical resistance.

For further increasing the mechanical stability of the filament in general or of a filament of a sintered metal powder, the filament could be composed at least in part of tantalum carbide, and/or rhenium carbide, and/or niobium carbide, and/or zirconium carbide. Concretely, one or more of the last-mentioned carbides could be used as a coating material for a filament of sintered metal powder. Quite generally, the filament could be coated with a coating material, which has a higher melt point than the filament material. A coating of the filaments as described above would make it possible to achieve during operation surface temperatures, which are higher than is usual for known tungsten filament lamps.

Concretely, the filament could be composed of a base body of sintered tantalum, which has an outer layer of tantalum carbide. Tantalum carbide is an extremely temperature-resistant hard material, which produces in the porous, spongy topology of the sintered material, because of, crosslinking, a high mechanical or static strength of the material in the fashion of a framework. Therefore, as expected, the filament material has an extremely high ohmic resistance and an adequate strength to avoid flowability of the hot filament during operation.

In an especially favorable manner in terms of construction, the flat section could be designed and constructed as a strip with two longitudinal sides. Furthermore, on the two longitudinal sides, respectively two surface elements could project from the strip in the fashion of wings. All four surface elements would extend from the strip, each at an angle of about 90°. In other words, the flat section could be present in the form of two channel sections, the two channel sections being coupled with each other at respectively one end and adjoining each other almost back to back. At the opposite end of the channel sections, the electrical bonding for the filament is provided. With such a flat section, the filament has a very favorable absorption behavior for heat radiation.

As an alternative to the foregoing configuration, it would be possible to make the flat section the form of a cup or cylinder jacket. In this connection, it is possible to have a configuration as a complete cylinder jacket or even a part thereof, in particular a cylinder jacket half. In the case of a substantially complete cylinder jacket, it would also be possible to make such a cylinder jacket on its side open or longitudinally slotted. This is favorable with respect to the thermal expansion behavior of the filament.

To ensure a particularly effective absorption of the heat radiation reflected from the inner side of the bulb, the diameter of the cylinder jacket, or cylinder jacket portion, or cylinder jacket half could be only slightly smaller than the diameter of the bulb. In this connection, the bulb could be tubular. In particular in this instance, it would be possible to arrange the filament in the bulb in concentric relationship and/or coaxial relationship with a longitudinal axis of the bulb.

Depending on its configuration, the filament could divide the interior of the bulb into one or more half spaces or subspaces.

The bulb could have such a large outer surface that surface heat, which is generated by, for example, absorption of the heat radiation, can be dissipated by convection cooling or any other forced cooling. The size and form of the filament and the bulb could be adapted to each other accordingly.

As a result of the large possible surface of the filament, it is possible to build light sources with high light outputs. It is likewise possible to adjust the color temperature of the light source independently of the surface temperature of the filament or incandescent element. This may occur by a spectrally selective mirror coating, which is capable of predetermining the transmitted spectral distribution of the radiation output emitted from the bulb and thus the color temperature.

In comparison with conventional filaments, the surface temperature of the filament may be adjusted lower, since the comparable visible light current can be generated by a larger and cooler surface of the filament. In this connection, the filament surface forms a new, additional degree of freedom in terms of construction.

While it is possible to operate the filament at a relatively low temperature, and while this also allows to achieve a relatively low evaporation of the filament material, a disturbing evaporation may occur because of the very large surface, which is as close as possible to the inner side of the bulb with respect to an effective absorption. As a result of the filament material, which has evaporated and settled on the inner side of the bulb, the reflectivity of the inner side of the bulb or of the mirror coating on the inner side of the bulb is reduced, and the absorption of the bulb or mirror coating and thermal dissipation respectively are increased. It is therefore desirable to minimize the evaporation of the filament material to the greatest extent possible.

For minimizing the evaporation of the filament material, the bulb could contain an inert gas and/or a halogen gas. In this instance, the halogen gas could contain bromine and/or iodine. With that, it would be possible to generate a normal tungsten iodide circulation in the case of a tungsten filament.

An alternative solution to the evaporation problems could occur by coating the filament with a coating material, which has a higher melt point than the filament material. This lies in the dependency of the temperature-dependent vapor pressure of a solid from its melt point. Furthermore, the deposit of the coating material could exhibit a lesser absorptivity than the deposit of the standard filament material. As a coating material with a very high melt point, it would be possible to use, for example, tantalum carbide, and/or rhenium carbide, and/or niobium carbide, and/or zirconium carbide.

As a result of the constructionally necessitated large filament surface, it is possible to generate very high light currents and to emit them from the light source, so as to enable an illumination of large building interiors or outdoor areas with only one light source according to the invention.

The above-described object is furthermore accomplished by a method for producing a light source of the initially described type wherein a filament of a sintered metal powder is provided in a first step. By sintering the metal powder, it is possible to control the conductivity of the sintered material by means of the initial grain size and the compacting of the powder as well as the sintering temperature. As a result, it is possible to produce a material of a correspondingly high ohmic resistance and mechanical stability. This enables the use of filaments with large, flat sections, without the conductor cross section, which is important for the electrical resistance, leading to a low resistance, and without mechanical instabilities occurring because of the large surface area and under the influence of gravity. Even at high operating temperatures, a sagging or flowing of the filament material does not occur.

Use is made of the porous, spongy topology of the sintered filament for generating a high mechanical stability of the material, in that the filament is exposed to an atmosphere of carbon dioxide or of carbon dioxide and inert gas for forming a metal carbide. In other words, by exposing the filament to a corresponding gas atmosphere, a metal carbide coating is produced on the outer side of the filament. Depending on the coating thickness or depth of penetration of the metal carbide reaction, the effective electrical resistance is further reduced. At process temperatures higher than 1000° C., the carbide starts to form, and at process temperatures higher than 1400° C., the complete carburetion occurs after a certain duration of the process.

The metal carbide is an extremely temperature-resistant hard material, which produces respectively a mechanical and a static strength of the filament because of a crosslinking in the porous, spongy topology of the filament material. Therefore, as expected, the filament material has an extremely high ohmic resistance and is adequately resistant for preventing a flow behavior of the hot filament during operation.

Once the formation of the metal carbide coating has generated an adequate strength, it is possible to increase the process temperature and, later, also the operating temperature of the metal carbide-metal filament above the melt point of the metal. The metal carbide forms a solid coating around the liquid metal core. Possible tension breaks in the metal carbide coating, for example, because of different thermal heat expansion coefficients, are repaired by the liquid metal exiting at the breaks, or by the then immediately starting formation of the metal carbide.

At the end of the production method, the filament is sealed into the bulb, and a light source having a high conversion efficiency is made available.

By rolling the filament to a foil after its preparation, it is possible to carry out an additional compacting step in the method, whereby conductivity is likewise influenced.

As regards a particularly reliable production of the filament, it would be possible to insert the filament after making it available, into a bulb that is open at two ends, and to bond it electrically at one end of the bulb. Thus, after having been provided and rolled, if necessary, the filament would be already available in the bulb in a protected manner. This provides a mechanical protection during further steps of the method.

After inserting the filament into the bulb, it would be possible to close the one end. In this process, one could arrange on the filaments, standard electrical connections, if need, of tungsten wire and/or molybdenum strips, and fuse or press them together with the end. The bulb could be formed by a quartz tube.

In a particularly simple manner, it would now be possible to expose the filament to an atmosphere of carbon dioxide or of carbon dioxide and inert gas by the inflow of a carbon dioxide gas or a gas of carbon dioxide and inert gas through the other end of the bulb. Furthermore, it would be possible to heat the filament electrically before and/or during the formation of a metal carbide. This would permit controlling the formation of metal carbide, if need be, until its completion. In particular, it would be possible to control the formation of metal carbide with the aid of the resistance characteristic of the filament. To this end, the heating current and heating voltage could be measured via the electrical bonding of the filament, and be accordingly used for the control. In other words, the formation of metal carbide could be directly monitored and, consequently, controlled via the electrical voltage-current characteristic or via the electrical resistance characteristic.

Other production methods, wherein the filaments of metal carbide and metal are not heated directly electrically and produced outside of the bulb, have the disadvantage that it is not possible to adjust directly the formation of the metal carbide or the electrical resistance of the filaments, which is to be attained, and that the filaments of metal carbide and metal may be very fragile outside of the bulbs.

As a metal powder, it would be possible to use tungsten, and/or rhenium, and/or niobium, and/or zirconium, and/or in particular tantalum. With the use of tantalum, it would be possible to make use of the extremely good deformability of tantalum. Since tantalum carbide has a very high melt temperature, one can expect at the normal operating temperatures of light sources, an extremely low evaporation speed of the tantalum carbide, and very little fogging of the bulb. Furthermore, tantalum carbide is black in the visible spectrum and, therefore, a high spectral emissivity of the tantalum carbide is present. In particular, in comparison with nonporous surfaces, the porous tantalum carbide surface shows an increased blackness in the meaning of the Planck blackbody radiation.

The further advantage of a filament of tantalum carbide and tantalum lies in its thermal conductivity, which is only about half as much in comparison with tungsten filaments. Together with the large reabsorbing surface of the filament of tantalum carbide and tantalum and the infrared radiation respectively, which is less often reflected on the inner sides of the bulb, and therefore less absorbed, and the comparably little thermal conductivity, a substantially lesser thermal dissipation is achieved. It would be possible to heat the filament of tantalum carbide and tantalum to the maximally possible operating temperature of tungsten filaments.

There exist various possibilities of improving and further developing the teaching of the present invention in an advantageous manner. To this end, one may refer to the following detailed description of a preferred embodiment of a light source with reference to the drawing. In conjunction with the detailed description of a preferred embodiment of a light source with reference to the drawing, also generally preferred improvements and further developments of the teaching are described.

DETAILED DESCRIPTION OF THE PREFERRED EMBODIMENTS

Figure 1:
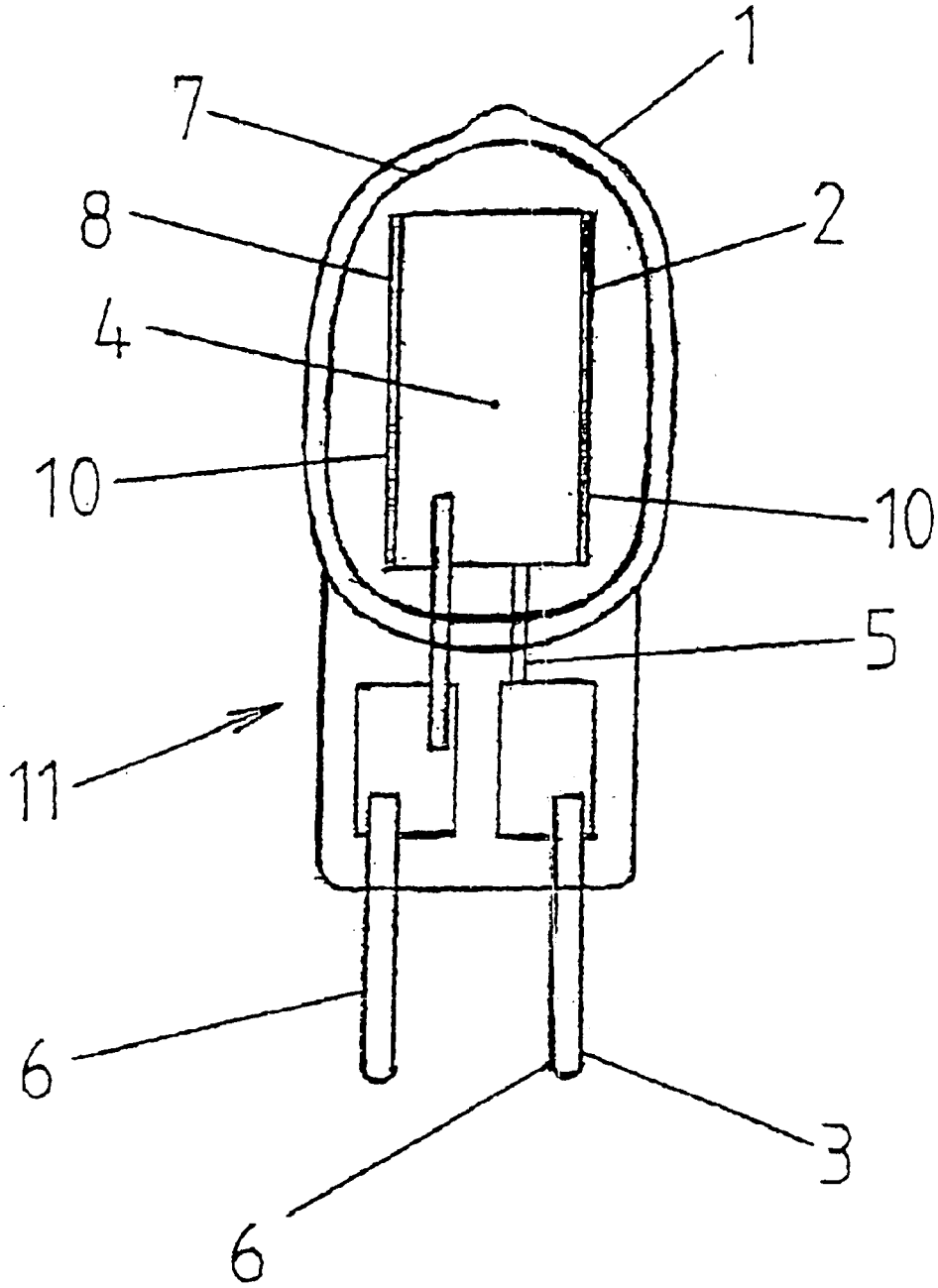
FIG. 1 is a perspective side view of the embodiment of a light source according to the invention.

FIG. 1 is a perspective side view of an embodiment of a light source according to the invention. The light source is designed and constructed as an incandescent lamp, which comprises a bulb 1 that accommodates a filament 2 or incandescent element. For heating the filament 2, a heating device 3 is provided, which makes available an electric current. The heated filament 2 emits both visible light and heat radiation.

With respect to a high conversion efficiency of the light source, the filament 2 comprises a flat section 4. The flat section 4 enables a high degree of absorption of the heat radiation reflected from the inner side of bulb 1 and originally radiated from filament 2, whereby the filament 2 is quasi backheated. Therefore, for achieving the same light output of the light source, it is possible to supply to the light source less energy than is the case with conventional light sources. Consequently, it is possible to operate the light of the present invention with less energy and thus more economically than conventional light sources.

Arranged on the filament 2 are power supply conductors 5, which are coupled with electrical contacts 6 of the heating device 3. The inner side of bulb 1 is provided with a mirror coating 7, which substantially increases the reflection power of the inner side of bulb 1 for the heat radiation.

The filament 2 is composed of essentially two channel sections 8. The channel sections 8 are electrically coupled at their upper ends. At their lower ends, the channel sections 8 are each bonded to a current supply conductor 5. In other words, the flat section 4 of filament 2 is constructed as a strip with two longitudinal sides 9, from which respectively two surface elements 10 project from the strip in the fashion of wings. A total of four surface elements 10 project from the strip, each at an angle of about 90°.

The entire electrical bonding of the light source is provided at an lower end 11 of bulb 1.

The filament 2 consists of a sintered tantalum powder and a coating of tantalum carbide on its surface.

Figure 2:
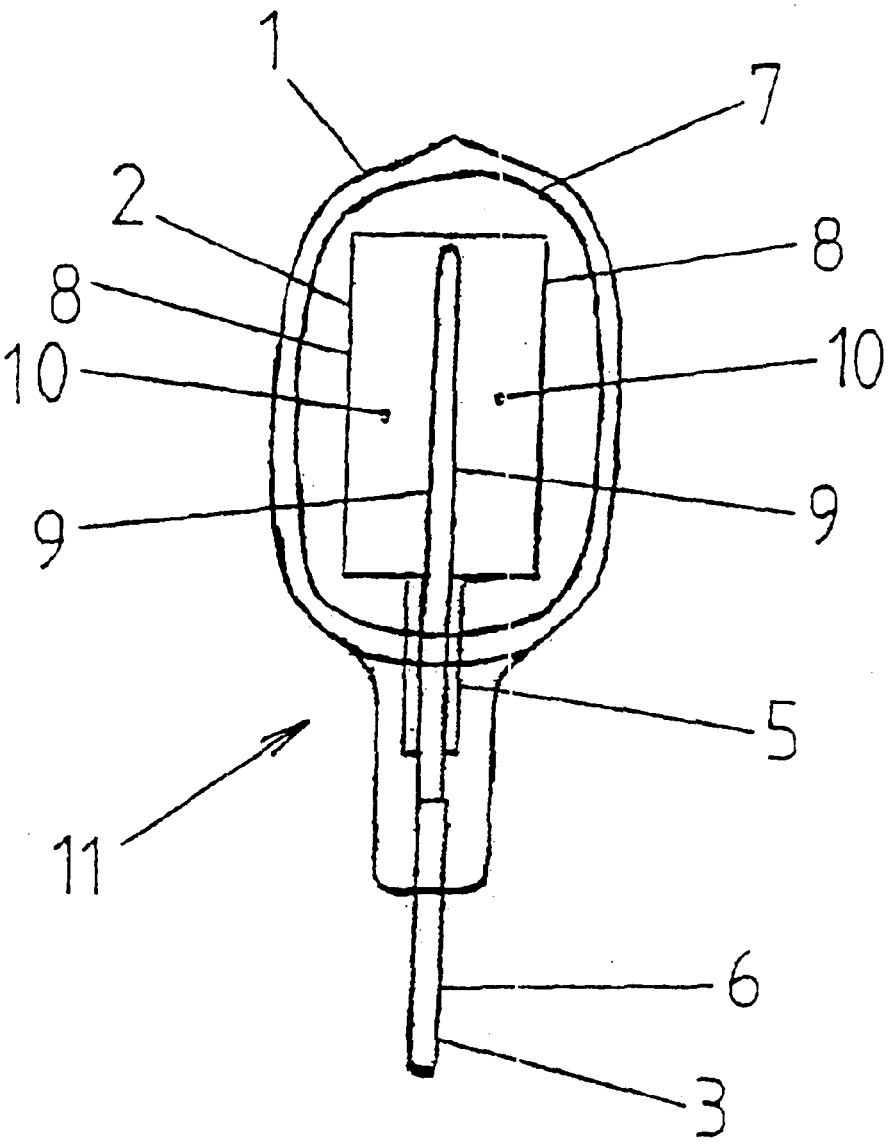
FIG. 2 is a perspective side view of the embodiment of FIG. 1, 90° out of phase relative to the view of FIG. 1.

FIG. 2 illustrates the light source of FIG. 1 in a position rotated by 90 degrees about the longitudinal axis of bulb 1. In this position, the surface elements 10 are best seen. The channel section 8 is formed respectively by two surface elements 10 and one strip or strip-shaped base portion of the filament 2. As regards the description of further elements of the light source, the description of FIG. 1 is herewith incorporated by reference.

Figure 3:
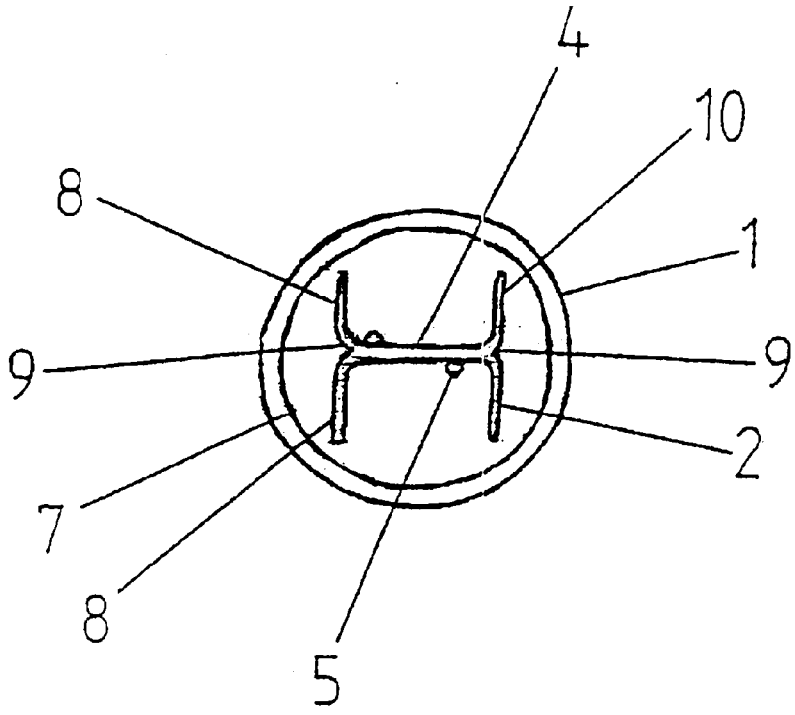
FIG. 3 is a top view of the embodiment of FIG. 1.

FIG. 3 illustrates the embodiment of a light source of FIG. 1 in a plan view. Best seen in this illustration are the two channel sections 8, which are interconnected at their upper ends. The filament 2 is arranged in bulb 1 in coaxial relationship therewith. The power supply conductors 5 are arranged on the inner sides of the channel sections 8. A mirror coating 7 is applied to the inner side of bulb 1. The surface elements 10 extend along the longitudinal sides 9 of the filament.

Figure 4:
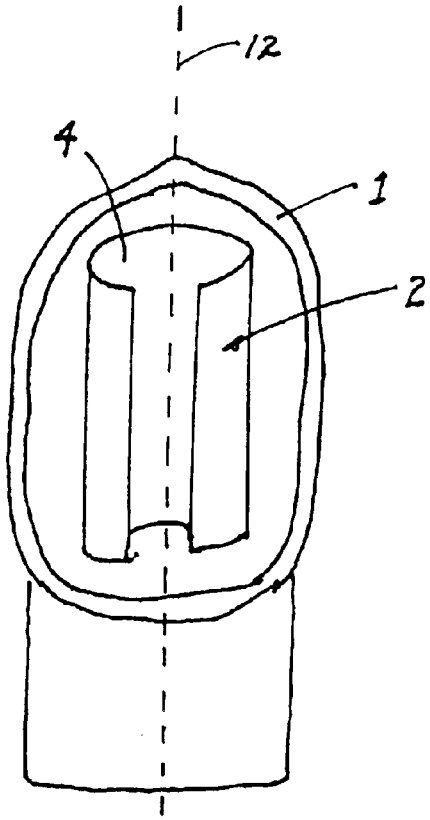
FIG. 4 is a view similar to FIG. 1 and schematically illustrating a second embodiment of the invention.
Figure 5:
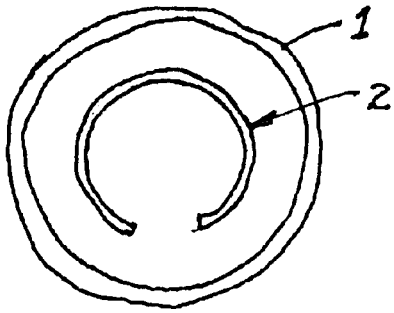
FIG. 5 is a top view of the embodiment of FIG. 4.

FIGS. 4 and 5 illustrate a further embodiment of the invention wherein the filament 2 has a flat section 4 which is in the form of a longitudinal cylindrical jacket which includes a lengthwise extending opening. Also, as best seen in FIG. 5, the cylindrical jacket defines a diameter which is only slightly smaller than a diameter defined by the bulb 1. Also, the bulb defines a longitudinal axis 12 and the filament 2 is configured to define a coaxial center axis.

From the above description, it will be apparent that the phrase "flat section" as used herein is intended to refer to a broad surface which may be planar or curved.

As regards further advantageous improvements and further developments of the teaching according to the invention, the general part of the description on the one hand and the attached claims on the other are herewith incorporated by reference.

Finally, it should be expressly emphasized that the foregoing, merely arbitrarily selected embodiment is used only for explaining the teaching of the present invention, without however limiting same to this embodiment.

What is claimed is:

1. A light source comprising a bulb having an inner surface and an outer surface, a filament mounted within said bulb and which includes a flat section, with said filament comprising tantalum carbide, a heating device for the filament whereby the filament can be heated to cause the emission of both visible light and heat radiation, and a dielectric multilayer coating positioned entirely on the inner surface of the bulb, said dielectric multilayer coating being spectrally selective so as to substantially reflect the heat radiation of the filament while substantially transmitting the visible light thereof.

2. The light source of claim 1 wherein the filament comprises a sintered metal powder.

3. The light source of claim 1 wherein said filament is coated with a coating material which has a higher melt temperature than the filament.

4. The light source of claim 3 wherein the coating material on said filament is selected from the group consisting of tantalum carbide, rhenium carbide, niobium carbide, zirconium carbide, and mixtures thereof.

5. The light source of claim 1 wherein the flat section of said filament comprises a strip with two longitudinal sides.

6. The light source of claim 5 wherein two surface elements project from each of the respective longitudinal sides of the strip in the form of wings.

7. The light source of claim 6 wherein each of the surface elements projects from the strip at an angle of about 90°.

8. The light source of claim 1 wherein the flat section of the filament is substantially planar.

9. The light source of claim 1 wherein the flat section of the filament is in the form of at least a portion of a cylindrical jacket.

10. The light source of claim 9 wherein the at least a portion of a cylindrical jacket includes a lengthwise extending opening.

11. The light source of claim 9 wherein the at least a portion of a cylindrical jacket defines a diameter which is smaller than a diameter defined by the bulb.

12. The light source of claim 9 wherein the bulb defines a longitudinal axis, with the filament being configured to define a coaxial center axis.

13. The light source of claim 1 wherein the heating device comprises a pair of electrical contacts coupled to the filament for delivering an electrical current to the filament.

14. The light source of claim 1 wherein the flat section of the filament is of inverted U-shaped configuration to define two longitudinal sides which are almost back to back and which are integrally coupled at upper ends thereof; and wherein the heating device includes a pair of electrical contacts joined to respective ones of the longitudinal sides adjacent the opposite ends thereof.

15. The light source of claim 14 wherein the two longitudinal sides are each in the form of a U-shaped channel section.

* * * * *